US005865594A

United States Patent [19]

Kim

[11] Patent Number: 5,865,594

[45] Date of Patent: Feb. 2, 1999

[54] DEVICE FOR DETACHABLY MOUNTING A WORK MEMBER TO CONSTRUCTION EQUIPMENT

[75] Inventor: Kee Young Kim, Koyang, Rep. of Korea

[73] Assignee: Volvo Construction Equipment Korea Co., Ltd., Rep. of Korea

[21] Appl. No.: 762,919

[22] Filed: Dec. 10, 1996

[30] Foreign Application Priority Data

Dec. 30, 1995 [KR] Rep. of Korea ..... 1995-68499

[51] Int. Cl.[6] ..... E02F 9/00

[52] U.S. Cl. ..... 414/723; 37/468

[58] Field of Search ..... 414/723; 403/324, 403/321, 325; 172/272–275; 37/468

[56] References Cited

U.S. PATENT DOCUMENTS 3,930,668 1/1976 Schuermann et al. .
4,020,975 5/1977 Stauffer .
4,586,867 5/1986 Stafford .
4,824,319 4/1989 Arnold .
4,955,779 9/1990 Knackstedt .
5,010,962 4/1991 Bloom, Jr. ..... 414/723 X
5,088,882 2/1992 Lovitt, Jr. ..... 414/723
5,110,254 5/1992 Aubrey .
5,310,275 5/1994 Lovitt ..... 37/468 X
5,590,483 1/1997 Kim ..... 172/272 X

*Primary Examiner*—Donald W. Underwood
*Attorney, Agent, or Firm*—Harness, Dickey & Pierce, P.L.C.

[57] ABSTRACT

Disclosed is a device for mounting an attachment to a heavy equipment or for detaching the attachment from the heavy equipment. The device can mount an attachment such as a bucket, and the like, to a working device of the heavy equipment, or can detach the attachment from the working device in accordance with an object to be processed. A circular bar is detachably mounted to a hook portion formed at a rear upper side of the bucket. A cover having a predetermined shape is fixed to a side plate which is formed downwards at the both sides of the circular bar. A housing receives a fixing pin which is installed in the both sides of the cover and is detachably mounted to the bucket. A hydraulic cylinder is supported by the fixing pin at its both ends. The hydraulic cylinder can mount the fixing pin to the bucket or can detach the fixing pin from the bucket.

6 Claims, 7 Drawing Sheets

DEVICE FOR DETACHABLY MOUNTING A WORK MEMBER TO CONSTRUCTION EQUIPMENT

BACKGROUND OF THE INVENTION

1. Field of the Invention

The present invention relates to a device for detachably mounting a work member, such as a bucket, to construction equipment, and more particularly, to a device for rapidly mounting a work member to construction equipment capable of preventing high loading forces and shock, generated during attachment and use of the work member, from being transmitted to a hydraulic cylinder.

2. Description of the Prior Art

A variety of devices for detachably mounting a work member to construction equipment have been proposed and used to selectively attach the proper work member to construction equipment as dictated by the working conditions.

U.S. Pat. Nos. 3,883,015 and 3,876,091 disclose a connecting device for connecting a work member to the main body of construction equipment, such a tractor and the like. The connecting device is connected to the work member at three positions. Consequently, this connecting device must support high loading forces during operation of the work member. These forces, resulting in high stresses, are concentrated at three attachment positions, thereby introducing wear and strain into the structure and component parts.

U.S. Pat. No. 3,243,066 discloses a device for detachably mounting a work member, such as a bucket and the like, to construction equipment by using a hydraulic cylinder as a power source. However, during operation of the work member, force and vibration are created and transmitted through a connecting pin, between the work member and the construction equipment, directly to the hydraulic cylinder. As a result, a potentially harmful shearing force is applied to a rod in the hydraulic cylinder.

U.S. Pat. No. 4,963,071 discloses a device for detachably mounting a work member, such as a bucket and the like, to construction equipment. In this device, a guide is installed to the rear upper side of the work member so as to aid in attachment. However, since this device requires the construction equipment to attach to the work member in a low position relative to the work member, two hydraulic cylinders are required, which increases the manufacturing cost of the device. Additionally, a pin which is used in the vertical position to mount the work member to the construction equipment, is subjected to shearing forces that may weaken the device.

Furthermore, typical designs require an operator to manually attach or detach a work member to the construction equipment. This manual operation results in a decrease in work efficiency. Alternatively, when the work member is attached to the construction equipment by using the hydraulic cylinder, high loading forces result in the hydraulic cylinder and/or attaching device. In both methods, loading forces and vibrations are transmitted directly to the hydraulic cylinder through the attaching device, resulting in a decreased working life of such equipment.

It is therefore desirable to provide an improved device for rapidly attaching and detaching a work member to construction equipment, while minimizing the transmission of high loading forces and vibration to the construction equipment and hydraulic cylinder.

SUMMARY OF THE INVENTION

It is an object of the present invention to provide a device for rapid attachment and detachment of a work member to construction equipment in a time efficient manner.

It is another object of the present invention to provide a device for detachably mounting a work member to construction equipment, capable of locking so as to insure safety in the event of hydraulic failure during use.

According to one embodiment of the present invention, a device is provided for detachably mounting a work member to construction equipment comprising:

a structural support having a circular bar being mountable to a hook formed on the rear upper portion of the work member, a plurality of side plates formed downward on both sides of the circular bar, and a cover having a predetermined shape being fixed within the plurality of side plates;

a housing for receiving a plurality of fixing pins, in which the fixing pins are installed in both sides of the cover so as to secure the work member to the device; and a hydraulic cylinder for engaging or disengaging the fixing pins to the work member, and the hydraulic cylinder being supported by the fixing pins on both ends.

Each fixing pin is slidably mounted to a connecting member. The connecting member is connected to a rod portion of the hydraulic cylinder, so as to prevent high loading forces and shock from being transmitted directly to the hydraulic cylinder.

The device further comprises a pressing plate which is slidably mounted between the fixing pin and the hydraulic cylinder, so as to further prevent high loading forces and shock from being transmitted directly to the hydraulic cylinder.

During attachment with a work member, the hydraulic cylinder is activated so as to force a rod portion, having a small diameter, against the pressing plate and fixing pin, thereby engaging the fixing pin with the work member.

According to another embodiment of the present invention, a device is provided for detachably mounting a work member to construction equipment comprising:

a structural support having a circular bar being mountable to a hook formed on the rear upper portion of the work member, a plurality of side plates formed downward on both sides of the circular bar, and a cover having a predetermined shape being fixed within the plurality of side plates;

a housing for receiving a plurality of fixing pins, in which the fixing pins are installed in both sides of the cover so as to secure the work member to the device;

an elastic member, installed within the housing, for elastically biasing an initial disengaged state of the fixing pins with respect to the work member; and a hydraulic cylinder for engaging and disengaging the fixing pins with the work member, and the hydraulic cylinder being supported by the fixing pins on both ends.

The device further comprises an intermediate member for supporting the hydraulic cylinder. The intermediate member is fixed to an end of the housing and is separated from the fixing pin so as to prevent high loading forces and shock from being transmitted to the hydraulic cylinder.

The device further comprises a cushion member for alleviating shock which is generated in the horizontal direction during the driving of the hydraulic cylinder. The cushion member is installed to an inner periphery of the intermediate member.

According to a third embodiment of the present invention, a device is provided for detachably mounting a work member to construction equipment comprising:

a structural support having a circular bar being mountable to a hook formed on the rear upper portion of the work member, a plurality of side plates formed downward on both sides of the circular bar, and a cover having a predetermined shape being fixed within the plurality of side plates;

a fixing pin, including a first diameter portion and a second diameter portion, being installed in both sides of the cover so as to engage or disengage the work member; and a hydraulic cylinder connected to the first diameter portion of the fixing pin through a connecting pin for engaging or disengaging the fixing pin with the work member.

The fixing pin is slidably mounted to a rod portion of the hydraulic cylinder via a connecting pin, so as to prevent high loading forces and shock from being directly transmitted to the hydraulic cylinder. A first gap is established by the difference between the outer diameter of the connecting pin and the inner diameter of the aperture in the rod portion of the hydraulic cylinder. A second gap is established by a difference between the outer diameter of the connecting pin and the inner diameter of the aperture in the first diameter portion of the fixing pin. Preferably, the size of the first gap is larger than that of the second gap.

A third gap is established by a difference between the outer diameter of the rod portion of the hydraulic cylinder and the inner diameter of the first diameter portion of the fixing pin. Preferably, the size of the second gap is smaller than that of the third gap. The fourth gap is established by a difference between the outer diameter of the second diameter portion of the fixing pin and the inner diameter of an aperture formed through the inner and outer side plates. Preferably, the size of the fourth gap is smaller than that of the first gap, and is smaller than that of the third gap.

Preferably, an inlet port supplying oil to the hydraulic cylinder and an outlet port for returning the oil from the hydraulic cylinder are inserted into a plurality of apertures formed through the cover in a horizontal line. The connection of these ports through the cover and into the hydraulic cylinder prevent the hydraulic cylinder from rotating during the driving of the rod portions.

The embodiments, as described above, allow for easy mounting and dismounting of work members to construction equipment so as to add convenience and simplicity to its operation. Furthermore, the device prevents high loading forces and shock from being transmitted directly to the hydraulic cylinder. Accordingly, the leakage of oil from the hydraulic cylinder is effectively prevented and the durability of the cylinder is highly enhanced.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE INVENTION

Figure 1:
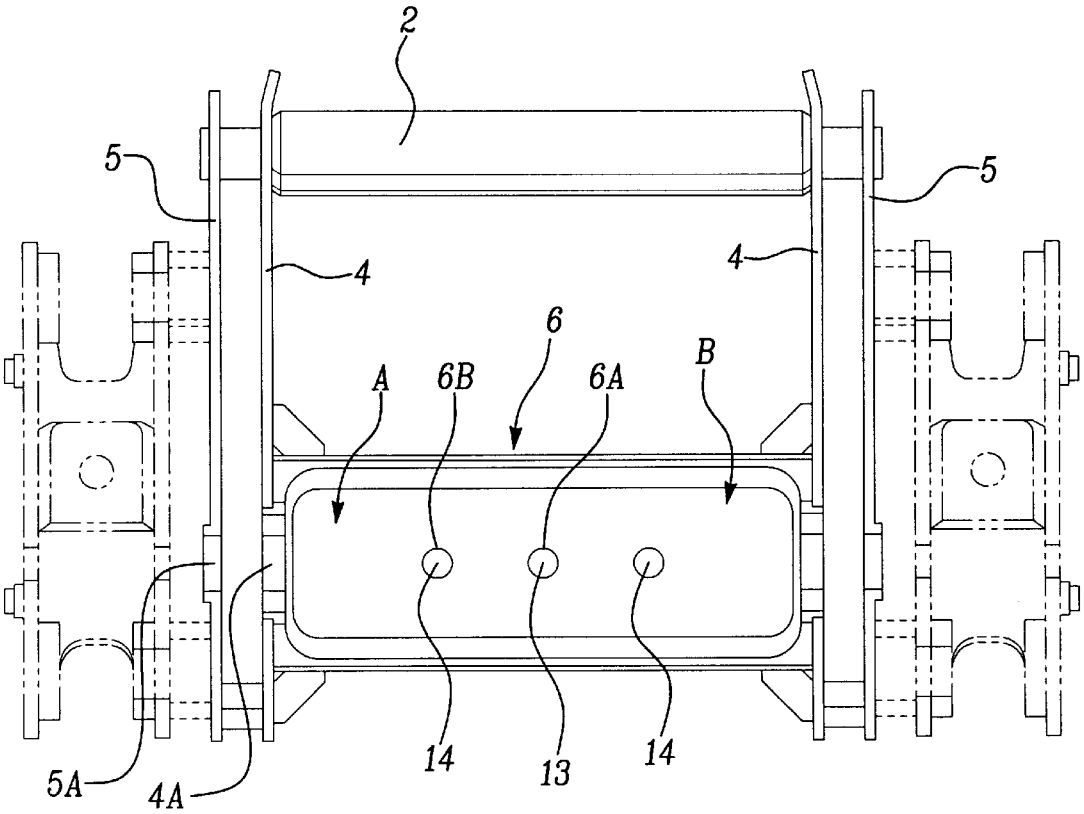
FIG. 1 is a rear view of one embodiment of the present invention capable of mounting a work member to construction equipment and detaching a work member from construction equipment.
Figure 2:
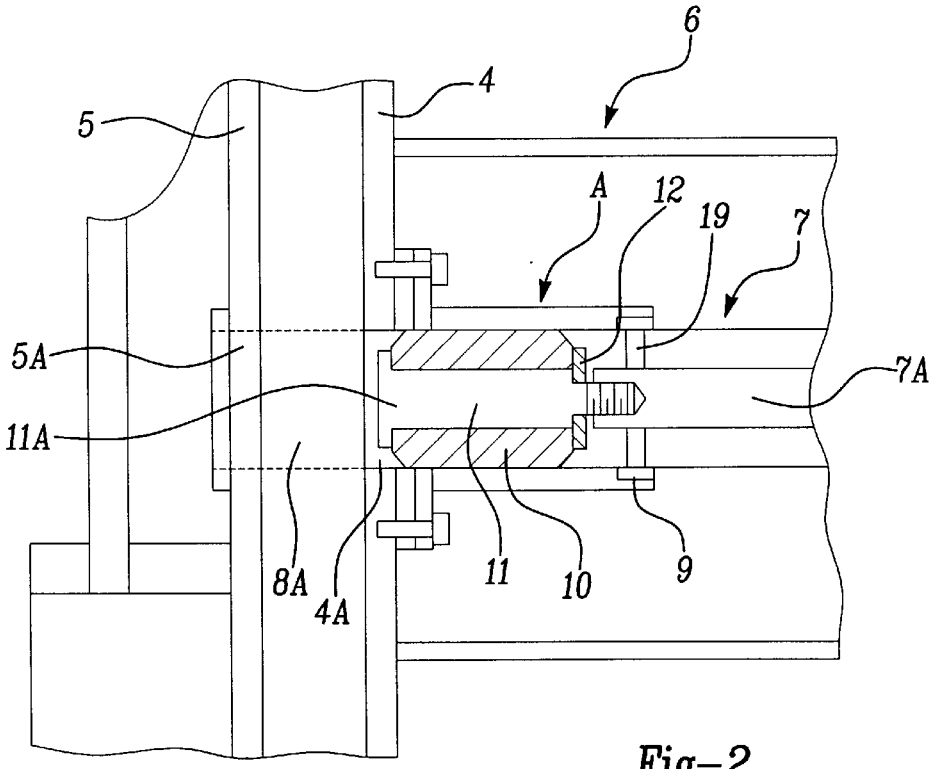
FIG. 2 is an enlarged detailed view of the lower left corner of FIG. 1.

FIGS. 1 and 2 illustrate a first example of a device for mounting a work member to construction equipment or for detaching the work member from the construction equipment according to a first embodiment of the present invention.

Referring to FIGS. 1 and 2, a circular bar 2 of a structural support can be mounted to a hook portion 1 which is formed at a rear upper side of a bucket 8 (refer to FIG. 5), or can be detached from hook portion 1. A plurality of inner plates 4 and a plurality of outer plates 5 for receiving a plurality of ribs 3 of bucket 8 are integrally formed with each other at both ends of cylindrical bar 2, and extend downward. A cover 6 having a predetermined shape is integrally fixed between inner plates 4.

A housing (A) and a housing (B), for supporting both ends of a hydraulic cylinder 7, are respectively fixed to inner plates 4. Hydraulic cylinder 7 is provided within a plurality of rod portions 7A at each end, and hydraulic cylinder 7 is installed in cover 6. The elements of housing (A) are the same as that of housing (B). Herein below, the elements of housing (A) will be described, but for simplicity the description relating to the elements of housing (B) will be omitted.

A spacer 19, for supporting an end of hydraulic cylinder 7, is mounted to an end of an inner periphery of housing (A).

A bushing-shaped cushion member 9, having an elastic force, is mounted to a position on which spacer 19 is mounted. Cushion member 9 can absorb and alleviate shock which is generated during the driving of hydraulic cylinder 7 and is applied in the horizontal direction.

A fixing pin 10 is installed in housing (A). Fixing pin 10 is connected to a rod portion 7A of hydraulic cylinder 7. Fixing pin 10 is mounted to ribs 3 of bucket 8 or is detached from ribs 3 during the driving of hydraulic cylinder 7. Fixing pin 10 is integrally mounted to an outer periphery of a connecting member 11. Connecting member 11 is connected to the rod portion 7A, so that it slidably moves in an inner side of housing (A) during the driving of hydraulic cylinder 7. Furthermore, fixing pin 10 is slidably mounted to the outer periphery of connecting member 11, so that it can slidably move in the horizontal direction on the outer periphery of connecting member 11. Thereby, fixing pin 10 can prevent high loading forces and shock, which are applied to fixing pin 10 during the use of the work member, from directly transmitting to hydraulic cylinder 7.

A pressing plate 12 is slidably mounted to connecting member 11 connecting fixing pin 10 with rod portion 7A, so that it can slidably move in the horizontal direction. When high loading forces and shock are generated, pressing plate 12 acts as an insulating device so as to prevent high loading forces and shock from being directly transmitted to hydraulic cylinder 7.

An inlet port 13, for supplying oil to hydraulic cylinder 7, and an outlet port 14, for returning oil from hydraulic cylinder 7, are fixed through combining holes 6*a* and 6*b*, respectively. Combining holes 6*a* and 6*b* are formed in a horizontal line through the outer periphery of cover 6. Thereby, the attachment of inlet port 13 and outlet port 14 prevent hydraulic cylinder 7 from rotating in cover 6 during the driving of hydraulic cylinder 7.

Figure 3:
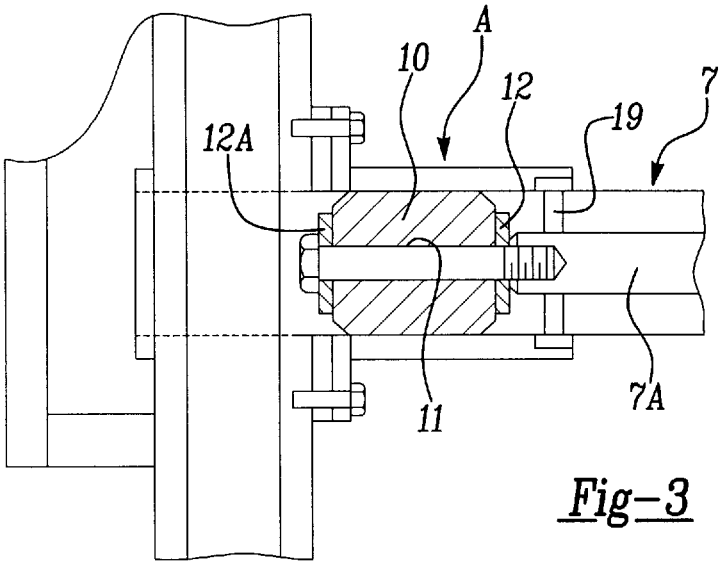
FIG. 3 shows one example of the device illustrated in FIG. 1.

FIG. 3 illustrates a second example of the device for mounting a work member to construction equipment or for detaching the work member from the construction equipment according to the first embodiment of the present invention.

Referring to FIG. 3, pressing plates 12 and 12A are slidably mounted to the right side and left side, respectively, of fixing pin 10 by means of connecting member 11 which is connected to rod portion 7A of hydraulic cylinder 7. Thereby, pressing plates 12 and 12A can slidably move in the horizontal direction.

Figure 4:
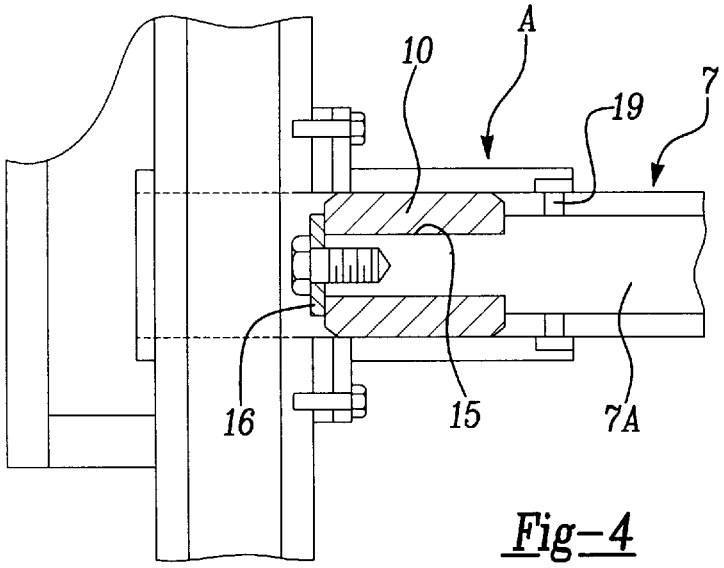
FIG. 4 shows another example of the device illustrated in FIG. 1.

FIG. 4 shows a third example of the device for mounting a work member to construction equipment or for detaching the work member from the construction equipment according to the first embodiment of the present invention.

Referring to FIG. 4, a small diameter portion 15 is formed at the end of rod portion 7A of hydraulic cylinder 7. Fixing pin 10 is mounted to the outer periphery of small diameter portion 15. A pressing plate 16 is mounted to the end of small diameter portion 15 so that fixing pin 10 can slidably move in the horizontal direction during the driving of hydraulic cylinder 7.

Herein below, an operation of the device according to the present invention as described above will be explained with reference to FIGS. 5 to 7.

Figure 5:
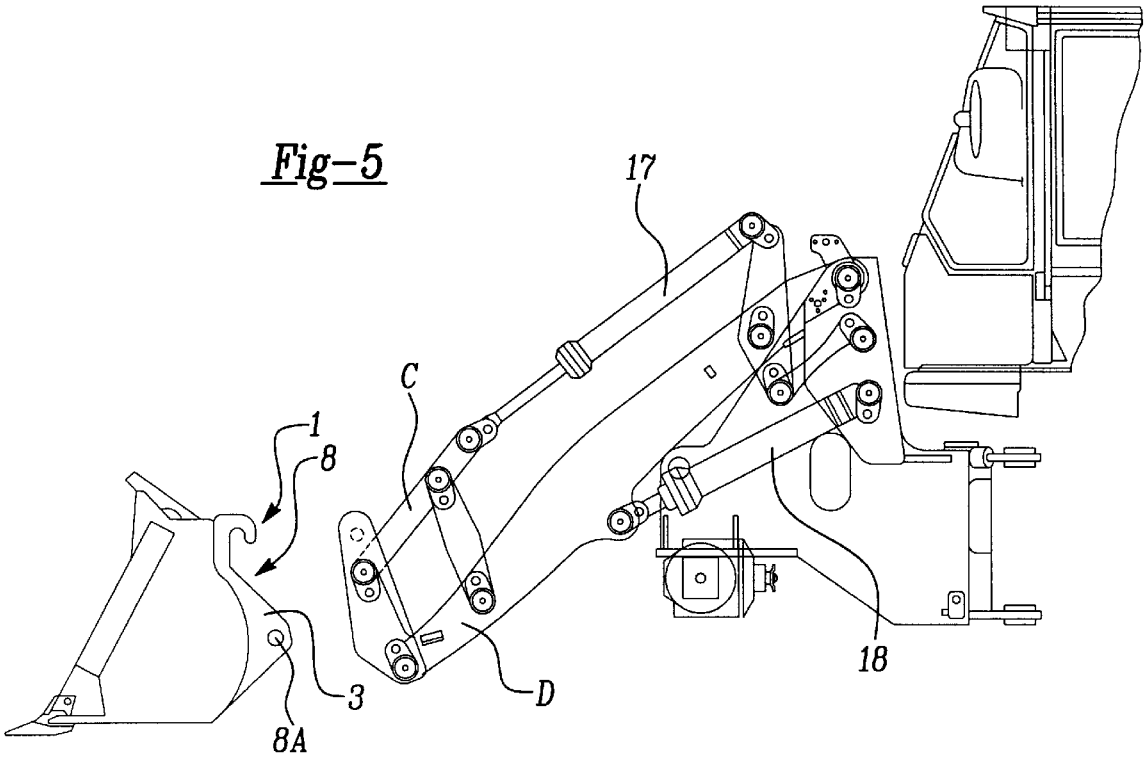
FIG. 5 shows a side view of the construction equipment and working member before attachment according to the present invention.

Referring to FIG. 5, when an operator wishes to mount a bucket 8 to a working device of construction equipment, the operator primarily moves the construction equipment, which is equipped with the device for detachably mounting a work member to construction equipment, toward the rear side of bucket 8 which is positioned on the ground. Thereafter, the operator drives a bucket cylinder 17 and 18 so that the upper portion of circular bar 2 is slanted to bucket 8. Thereby, circular bar 2 can be safely mounted to hook portion 1 which is formed at the rear upper side of bucket 8.

Figure 6:
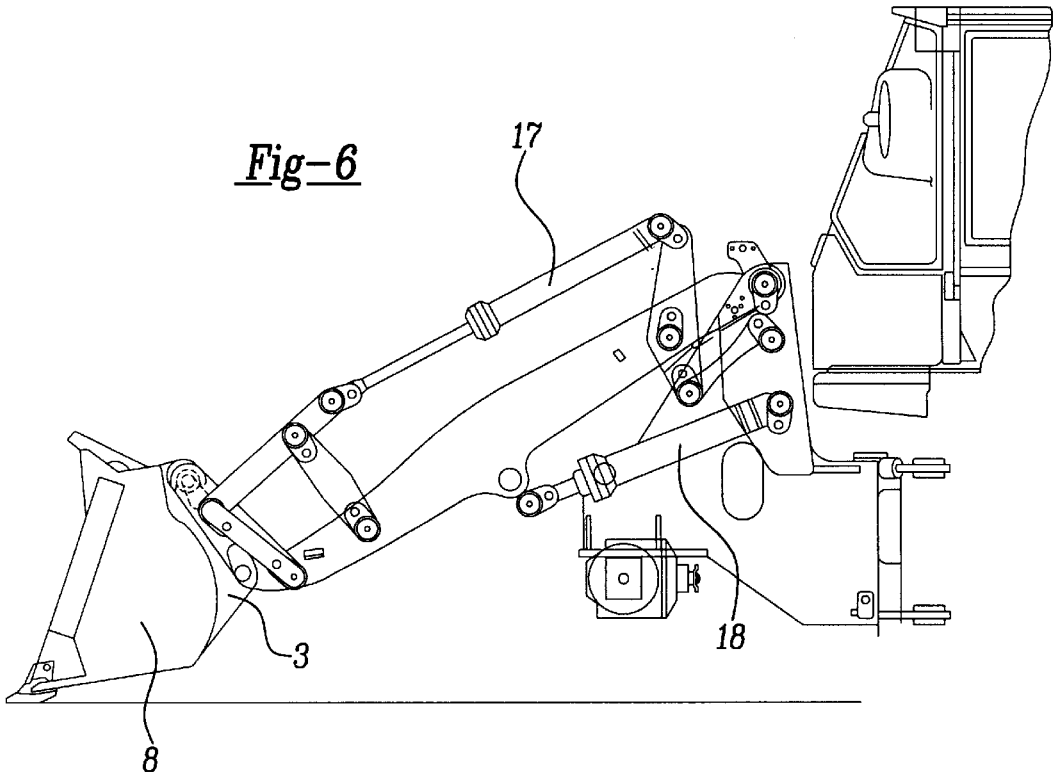
FIG. 6 shows a side view of the construction equipment and working member prior to complete attachment according to the present invention.

Referring to FIG. 6, when circular bar 2 is safely mounted to hook portion 1, the operator raises bucket 8 toward the construction equipment by retracting bucket cylinder 17. As a result, a rear bottom face of bucket 8 is raised from the ground. Bucket 8 is received into a space between inner side plate 4 and outer side plate 5 due to its own weight. At this time, a combining hole 8A in bucket 8 is positioned in the center line of hydraulic cylinder 7 and fixing pin 10.

Figure 7:
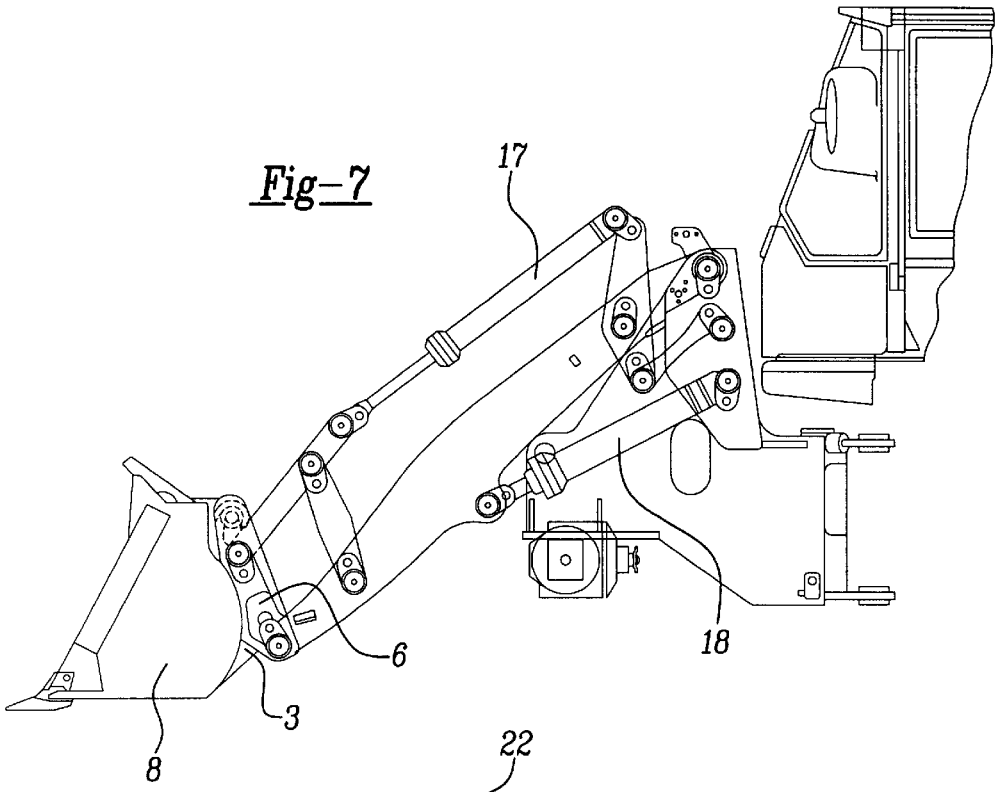
FIG. 7 shows a side view of the construction equipment and working member after attachment according to the present invention.
Figure 8:
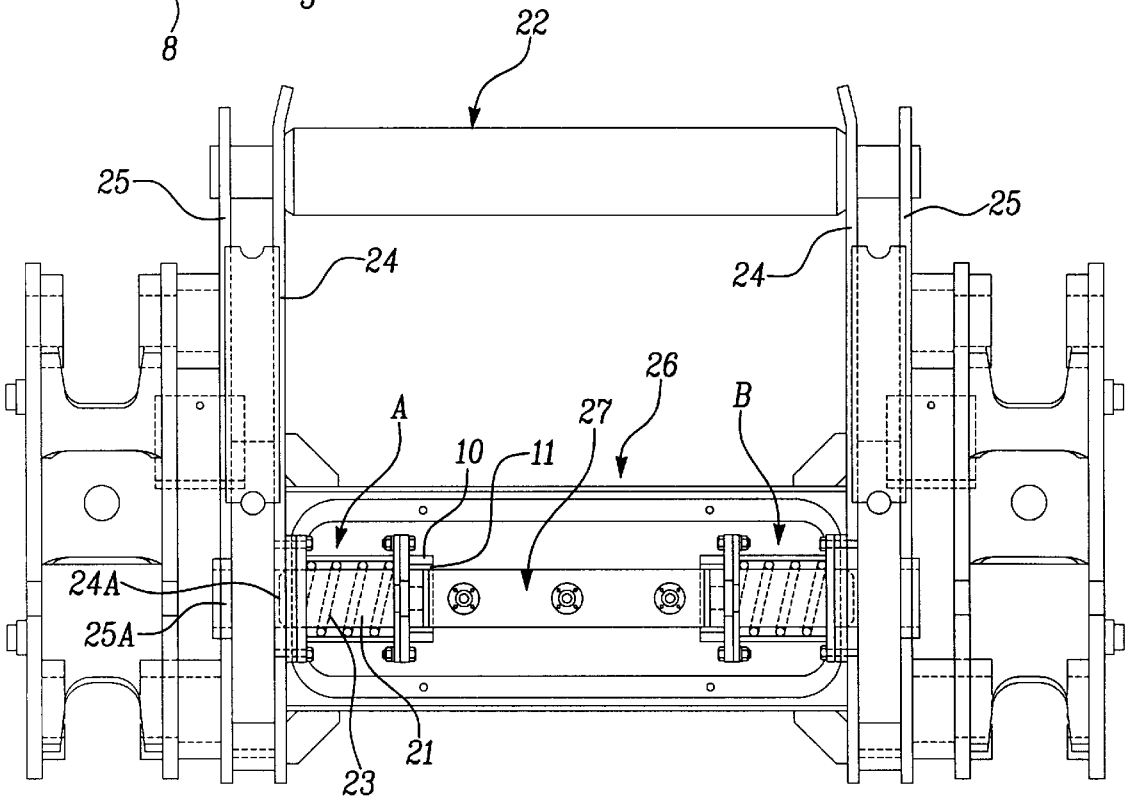
FIG. 8 is a rear view of another embodiment of the present invention capable of mounting a work member to construction equipment and detaching a work member from construction equipment.
Figure 9:
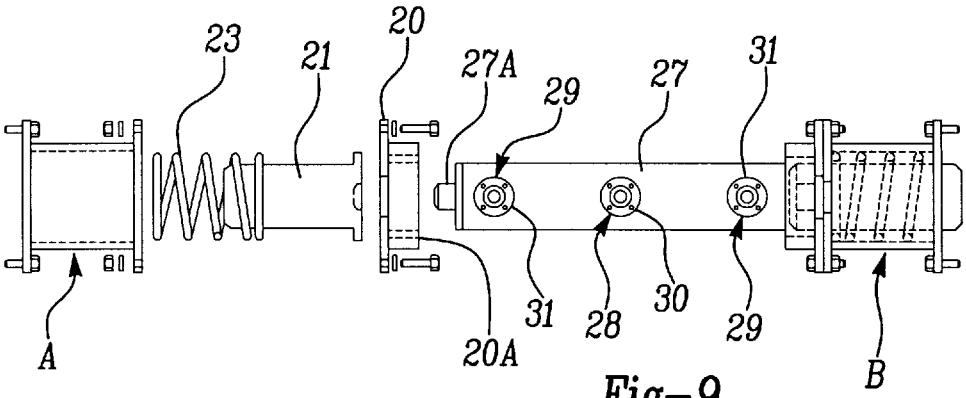
FIG. 9 shows an exploded view of the working elements of the second embodiment of the present invention.

Referring to FIG. 7, rod portions 7A and hydraulic cylinder 7 extend outward by introducing a working oil through inlet port 13 of hydraulic cylinder 7 into hydraulic cylinder 7. As a result, pressing plate 12 which is connected to connecting member 11, pushes fixing pin 10 leftward. Accordingly, fixing pin 10 can slidably move through an aperture 4A of inner side plate 4, combining hole 8A of rib 3, and is inserted into an aperture 5A of outer side plate 5. Thereby, a mounting job of the bucket is completed.

Therefore, the operator of the construction equipment can perform a predetermined job by using bucket 8 mounted to the construction equipment. The high loading forces and shock which are generated from fixing pin 10 join to bucket 8 during use of the work member can be applied to the fixing pin 10 in the circumferential direction by ribs 3 of the bucket 8. At this time, fixing pin 10 and pressing plate 12, which are joined to the outer periphery of a connecting member 11, are slidably mounted to rod portion 7A of hydraulic cylinder 7. Thereby, fixing pin 10 and pressing plate 12 can slidably move in the horizontal direction. As a result, high loading forces and shock cannot be transmitted to hydraulic cylinder 7 directly.

In order to detach bucket 8 from the construction equipment, working oil is introduced through outlet port 14 of hydraulic cylinder 7 into hydraulic cylinder 7. Then, rod portion 7A of hydraulic cylinder 7 is withdrawn, and fixing pin 10 is detached from inner side plate 4, outer side plate 5, and ribs 3 of bucket 8 by means of a locking stage 11A of connecting member 11, which is connected to rod portion 7A. Thereby, fixing pin 10 returns to housing (A). As a result, bucket 8 is separated from the working device.

FIGS. 8–11 illustrate a device for mounting a work member to construction equipment or for detaching the work member from construction equipment according to a second embodiment of the present invention.

Referring to the figures, circular bar 22 of a structural support can be mounted to a hook portion 1 which is formed at the rear upper side of a bucket 8 (refer to FIG. 5), or can be detached from hook portion 1. A plurality of inner plates 24 and a plurality of outer plates 25 for receiving a plurality of ribs 3 of the bucket 8 are integrally formed with each other at both ends of the circular bar 22, and extend downwards. A cover 26 having a predetermined shape is integrally fixed between the inner plates 24.

A housing (A) and a housing (B), for supporting both ends of the hydraulic cylinder 27, are respectively fixed to inner plates 24. Hydraulic cylinder 27 is provided with a plurality of rod portions 27A at each end, and hydraulic cylinder 27 is installed in cover 26. The elements of housing (A) are the same as that of housing (B). Herein below, the elements of housing (A) will be described, but for simplicity the description relating to the element of the housing (B) will be omitted.

A fixing pin 21 is installed in housing (A). Fixing pin 21 can be inserted into or can be released from combining hole 8A of bucket 8. An intermediate member 20 is integrally fixed to one side of housing (A). Both ends of fixing pin 21 are supported by intermediate member 20. Intermediate member 20 supports an end of hydraulic cylinder 27 so that high loading forces which are generated during use of the work member cannot be transmitted to hydraulic cylinder 27.

A bushing-shaped cushion member 20A, having an elastic force, is mounted to an inner periphery of intermediate member 20. Cushion member 20A can alleviate loading forces which are generated during the driving of hydraulic cylinder 27 and are applied in the horizontal direction. An elastic member 23, for returning fixing pin 21 joined to ribs 3 of bucket 8 during the shrinkage of hydraulic cylinder 27, is installed in housing (A) under the state that fixing pin 21 is separated from bucket 8.

An inlet port 28, for supplying an oil to hydraulic cylinder 27, and an outlet port 29, for returning oil from hydraulic cylinder 27, are fixed through combining holes 30 and 31, respectively. Combining holes 30 and 31 are formed in a horizontal line through cover 26. Thereby, the attachment of inlet port 28 and outlet port 29 prevent hydraulic cylinder 27 from rotating in cover 26 during the driving of hydraulic cylinder 27.

Herein below, an operation of the device according to the second embodiment of the present invention as described above will be explained.

Figure 10:
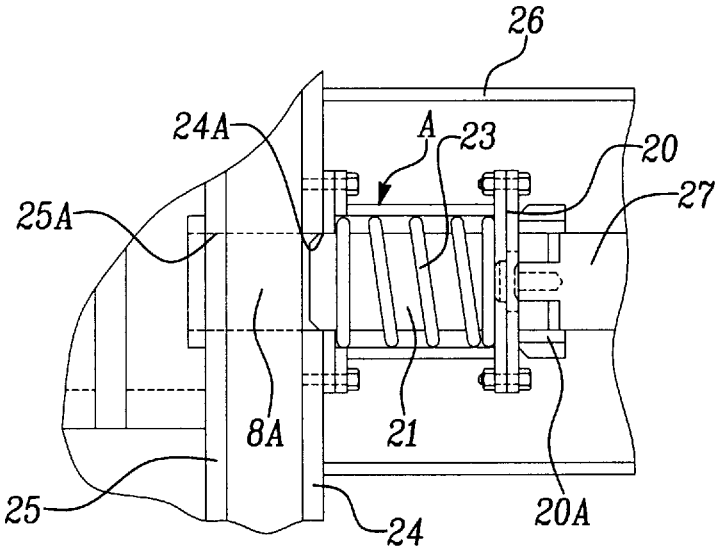
FIG. 10 shows a detailed view of the second embodiment in a disengaged state.
Figure 11:
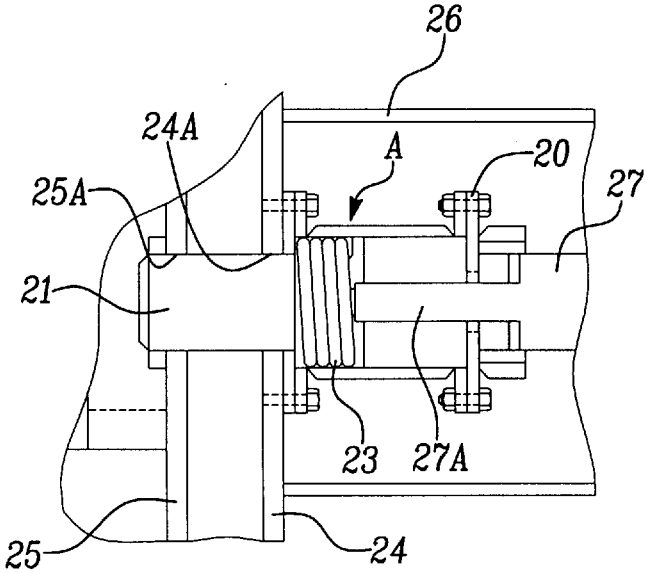
FIG. 11 shows a detailed view of the second embodiment in an engaged state.

Referring to FIGS. 10 and 11, when an operator wishes to mount bucket 8 to a working device of construction equipment, the operator primarily moves the construction equipment, which is equipped with the device for detachably mounting a work member to construction equipment, toward the rear side of bucket 8 which is positioned on the ground. Thereafter, the operator drives a bucket cylinder 17 and 18 so that the upper portion of circular bar 22 is slanted to bucket 8. Thereby, circular 22 can be safely mounted to hook position 1 which is formed at the rear upper side of bucket 8.

Under the state that circular bar 22 is safely mounted to hook portion 1, the operator raises bucket 8 toward the construction equipment by retracting bucket cylinder 17. As a result, hydraulic cylinder 27 and fixing pin 21 are positioned in the center line of combining hole 8A which is formed at ribs 3 of bucket 8.

At this time, as shown in FIG. 11, rod portions 27A of hydraulic cylinder 27 extend outward by introducing a working oil through inlet port 28 of hydraulic cylinder 27 into hydraulic cylinder 27. As a result, rod portions 27A pass through intermediate member 20, and push fixing pin 21 leftward. Accordingly, fixing pin 21 can slidably move through an aperture 24A of inner side plate 24, combining hole 8A of ribs 3, and is inserted into an aperture 25A of outer side plate 25. Thereby, mounting job of bucket 8 is completed.

At this time, elastic member 23, which is installed in the housing (A), is compressed by moving fixing pin 21.

When an operator performs a predetermined job by using bucket 8 mounted to the working device, high loading forces and shock are transmitted from fixing pin 21 to intermediate member 20. At this time, intermediate member 20 prevents loading forces and shock from being transmitted to hydraulic cylinder 27 directly.

Meanwhile, as shown in FIG. 10, when an operator wishes to separate bucket 8 from the device for mounting a work member to a construction equipment or for detaching the work member from the construction equipment, the operator allows oil through outlet port 29 of hydraulic cylinder 27 into hydraulic cylinder 27. As a result, hydraulic cylinder 27 is retracted. Accordingly, fixing pin 21 is detached from outer side plate 25, ribs 3 of bucket 8, inner side plate 24 by means of the restoring force of elastic member 23 which is installed in housing (A). Fixing pin 21 returns to housing (A), thereby allowing bucket 8 to be detached from the working device.

FIGS. 12–15 illustrate a device for mounting a work member to construction equipment or for detaching the work member from construction according to a third embodiment of the present invention.

Referring to the figures, a circular bar 35 of a structural support can be mounted to a hook portion 1 which is formed at a rear upper side of a bucket 8 (refer to FIG. 5), or can be detached from hook portion 1. A plurality of inner plates 32 and a plurality of outer plates 33 for receiving a plurality of ribs 3 of bucket 8 are integrally formed with each other at the ends of circular bar 35 and extend downward. A box-shaped cover 34 is integrally fixed between inner plates 32 by welding.

Combining holes 8A are formed at lower portions of ribs 3 of bucket 8. Since circular bar 35 is safely positioned in hook portion 1 of bucket 8 and is tilted toward the construction equipment by retracting bucket cylinder 17, the center line of the combining holes 8A is positioned at the same center line of hydraulic cylinder 37 which is received in cover 34.

A fixing pen 36 is mounted into combining holes 8A or is detached from combining holes 8A by driving hydraulic cylinder 37. A combining hole 39 is formed through a first diameter portion 38 of fixing pin 36. A rod portion 37A of hydraulic cylinder 27 is inserted into combining hole 39. A throughhole 41 and 42 are formed through rod portion 37A and the first diameter portion 38 of fixing pen 36 in the circumferential direction, respectively. When fixing pin 36 is connected to rod portion 37A, connecting pin 40 is inserted into throughholes 41 and 42.

At this time, fixing pin 36 is slidably mounted to rod portion 37A in the axial direction so that high loading forces and shock, which are applied to the fixing pin during use of the work member, cannot be directly transmitted to hydraulic cylinder 37.

The outer diameter of connecting pin 40 is smaller than the inner diameter of throughhole 41, which is formed through rod portion 37A. As a result, a first gap is established by a difference between the outer diameter of connecting pin 40 and the inner diameter of throughhole 41. The outer diameter of connecting pin 40 is smaller than an inner diameter of throughhole 42, which is formed through a first diameter portion 38 of fixing pin 36. As a result, a second gap is established by a difference between the outer diameter of connecting pin 40 and the inner diameter of throughhole 42. The size of the first gap is larger than that of the second gap.

When fixing pin 36 is connected to hydraulic cylinder 37, a third gap is established by a difference between an outer diameter of an end 37B of rod portion 37A and the inner diameter of combining hole 39, which is formed through first diameter portion 38. The size of the first gap is smaller than that of the third gap.

In addition, a fourth gap is established by a difference between an outer diameter of second diameter portion 36A of fixing pin 36 and an inner diameter of aperture 46, which are formed through side plate 32 and 33. The size of the fourth gap is smaller than that of the first gap and that of the third gap.

An inlet port 43, for supplying oil to hydraulic cylinder 37, and an outlet port 44, for returning oil from hydraulic cylinder 37, are fixed through combining holes 34A and 34B, respectively. Combining holes 34A and 34B are formed in a horizontal line through cover 34. Thereby, the attachment of inlet port 43 and outlet port 44 prevent hydraulic cylinder 37 from rotating in cover 36 during the driving of hydraulic cylinder 37.

A split pin 45 prevents connecting pin 40 from detaching from throughholes 41 and 42, which are respectively formed through rod portion 37A of hydraulic cylinder 37 and first diameter portion 38 of fixing pin 36.

Herein below, an operation of the device according to the third embodiment of the present invention as described above will be explained.

Figure 14:
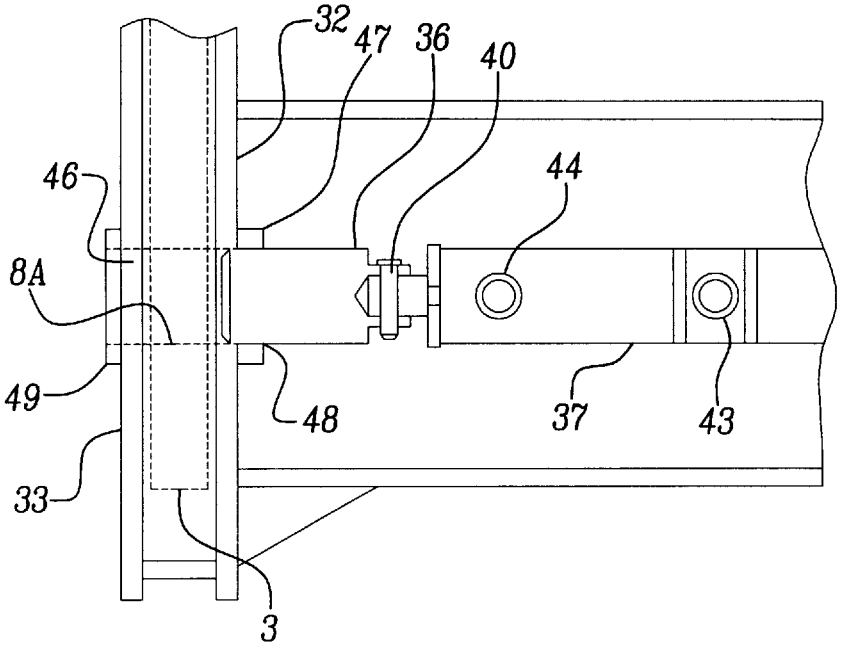
FIG. 14 shows the working elements of the third embodiment in a disengaged state.
Figure 15:
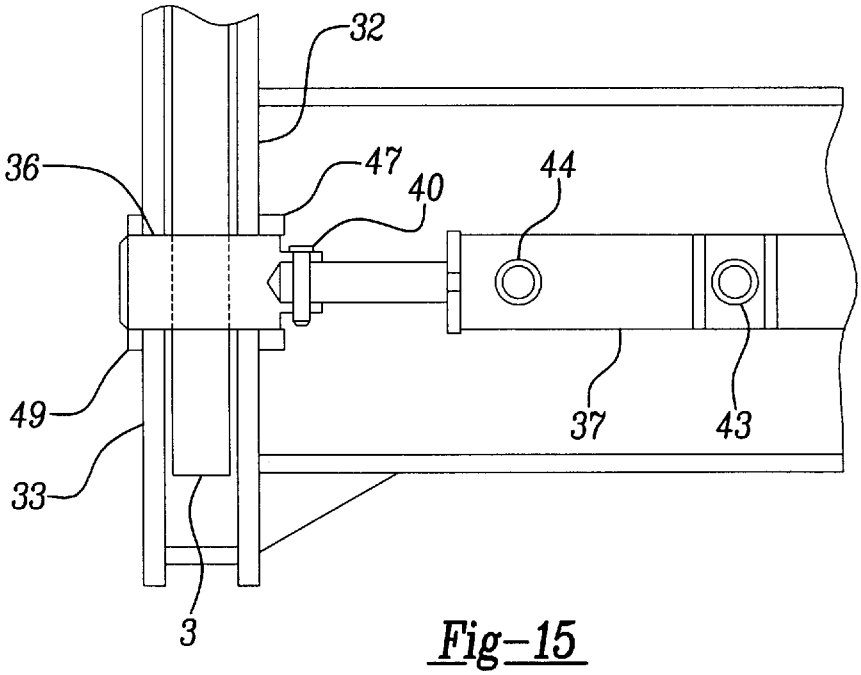
FIG. 15 shows the working elements of the third embodiment in an engaged state.

Referring to FIGS. 14 and 15, when an operator wishes to mount bucket 8 to a working device of construction equipment, the operator primarily moves the construction equipment, which is equipped with the device for detachably mounting a work member to construction equipment, toward the rear side of bucket 8 which is positioned on the ground. Thereafter, the operator drives a bucket cylinder 17 and 18 so that the upper portion of circular bar 35 is slanted to bucket 8. Thereby, circular bar 35 can be safely mounted to hook portion 1 which is formed at the rear upper side of bucket 8.

When circular bar 35 is safely mounted to hook portion 1, the operator raises bucket 8 towards the construction equipment by retracting bucket cylinder 17. As a result, ribs 3 of bucket 8 are received into a space between inner side plate 32 and outer side plate 33 due to its own weight. At this time, the hydraulic cylinder 37 and the fixing pin 36 are positioned in the center line of the combining hole 8A of bucket 8.

As shown in FIG. 15, rod portions 37A of hydraulic cylinder 37 extend outward by introducing a working oil through inlet port 43 of hydraulic cylinder 37 into hydraulic cylinder 37. As a result, end 37B of rod portion 37A is brought into contact with an inner side face 38A of combining hold 39, which is formed through first diameter portion 38 of fixing pin 36. Thereafter, rod portion 37B pushes fixing pin 36 so that the fixing pin passes through an inner hole 48 of a boss 47, which is formed at inner side plate 32; combining hole 8A, which is formed through ribs 3 of bucket 8; and a boss 49 of outer side plate 33 in due sequence. Thereby, a mounting job of bucket 8 is completed.

When an operator performs a predetermined job by using bucket 8 mounted to the working device, high loading forces and shock, which are generated from fixing pin 36 join to bucket 8, are applied to fixing pin 36. However, since fixing pin 36 is slidably mounted to rod portion 37A of hydraulic cylinder 37, high loading forces and shock, which are exerted upon fixing pin 36, are not transmitted to hydraulic cylinder 37 directly.

Referring to FIG. 14, when an operator wishes to separate bucket 8 from the device for detachably mounting a work member to construction equipment, the operator allows oil in through outlet 44 of hydraulic cylinder 37 into hydraulic cylinder 37. As a result, hydraulic cylinder 37 is withdrawn. Accordingly, connecting pin 40 is brought into contact with throughhole 42, which is formed through fixing pin 36. Thereby, fixing pin 36 disengages from inner side plate 32, outer side plate 33, and ribs 3 of bucket 8. As a result, bucket 8 can be separated from the construction equipment.

A fifth gap is established by a difference between the outer diameter of fixing pin 36 and the inner diameter of boss 47, which is formed through inner side plate 32. The size of the fifth gap is larger than that of the third gap which is established by the difference between the outer diameter of end 37B of rod portion 37A and the inner diameter of combining hole 39 which is formed through first diameter portion 38. Furthermore, the size of the fifth gap is larger than that of the first gap, which is established by the difference between the outer diameter of connecting pin 40 and the inner diameter of throughhole 41.

Figure 12:
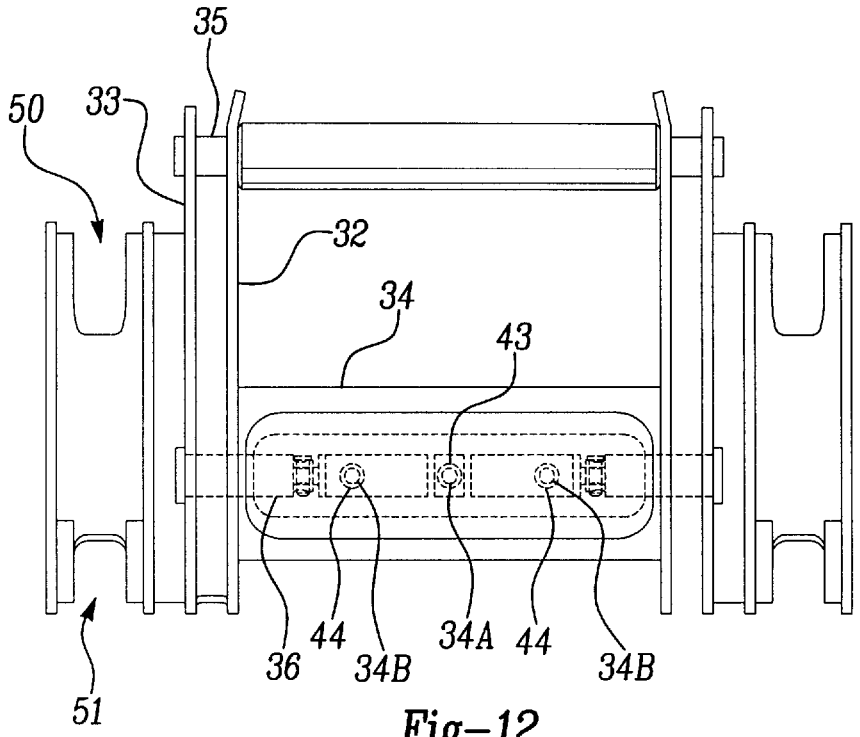
FIG. 12 is a rear view of yet another embodiment of the present invention capable of mounting a work member to construction equipment and detaching a work member to construction equipment.
Figure 13:
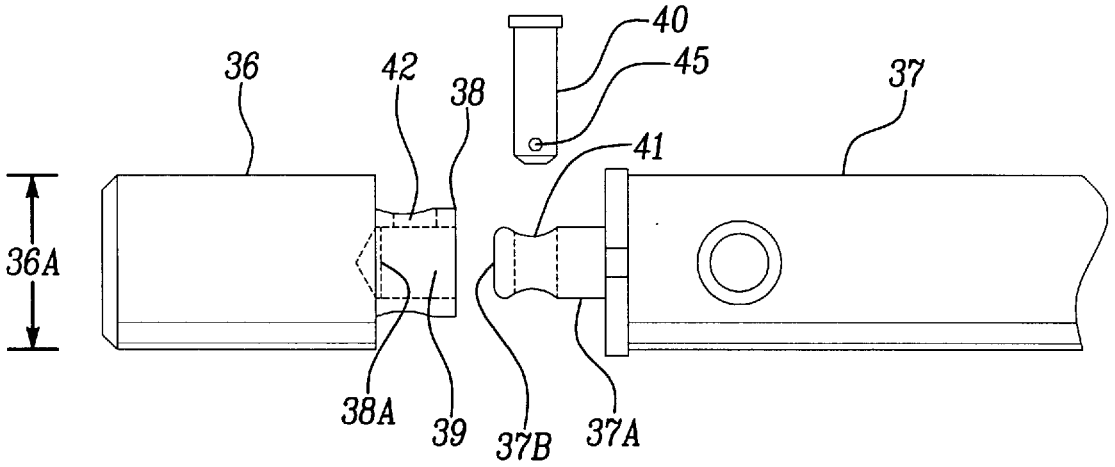
FIG. 13 shows an exploded view of the working elements of the third embodiment of the present invention.

Meanwhile, in FIG. 12, the reference numeral '50' represents a connection place in which the device is rotatably connected to the rink (C), so as to allow bucket 8 to be driven forward and backward by means of bucket cylinder 17. The reference numeral '51' represents a fixing place to pivotally fix the boom cylinder 18 to the device so as to raise and descend bucket 8.

As described above, the device for detachably mounting a work member to construction equipment according to the present invention can easily mount or detach a work member such as a bucket. Consequently, the device offers convenience to an operator thereof. Further, the device prevents high loading forces and shock, which are generated during the use of the equipment, from directly transmitting to the hydraulic cylinder used for mounting or detaching the bucket. Accordingly, the leakage of oil from the hydraulic cylinder is effectively prevented and the durability of the device is highly enhanced. In addition, economic gains obtained by the device are enhanced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for mounting a work member to a working device of construction equipment, said device comprising:

a circular bar being detachably mountable to the work member;

a plurality of side plates being coupled to and extending downwardly from both ends of said circular bar;

a cover having a predetermined shape being fixed into an inner side of said plurality of side plates;

at least one fixing pin for selectively engaging and disengaging the work member through at least one aperture formed through said plurality of side plates;

at least one housing disposed within said cover for receiving said at least one fixing pin;

a hydraulic cylinder for releasably engaging and disengaging said at least one fixing pin with the work member, said hydraulic cylinder being supported by said at least one fixing pin at one end of said hydraulic cylinder; and an isolation device slidably mounting said at least one fixing pin to at least one connecting member, said at least one connecting member being connected to a rod portion of said hydraulic cylinder, such that loading forces and shock being applied to said at least one fixing pin during use of said work member cannot be directly transmitted to said hydraulic cylinder.

2. The device as claimed in claim 1 wherein said isolation device further comprises a pressing plate being slidably mounted between said at least one fixing pin and said rod portion of said hydraulic cylinder such that loading forces and shock cannot be directly transmitted to said hydraulic cylinder.

3. The device as claimed in claim 1 wherein said isolation device further comprises at least two pressing plates, wherein one of said at least two pressing plates is connected to each end of said at least one fixing pin by said connecting member.

4. A device for mounting a work member to a working device of construction equipment, said device comprising:

a circular bar being detachably mountable to the work member;

a plurality of side plates being coupled to and extending downwardly from both ends of said circular bar;

a cover having a predetermined shape being fixed into an inner side of said plurality of side plates;

at least one fixing pin for selectively engaging and disengaging the work member through at least one aperture formed through said plurality of side plates;

at least one housing disposed within said cover for receiving said at least one fixing pin;

a hydraulic cylinder for releasably engaging and disengaging said at least one fixing pin with the work member, said hydraulic cylinder being supported by said at least one fixing pin at one end of said hydraulic cylinder; and an isolation device for minimizing loading forces and shock from being directly transmitted from said at least one fixing pin to said hydraulic cylinder during the use of the work member, said isolation device enabling said at least one fixing pin to be slidably engagable or disengagable with the work member and an end of a rod portion of said hydraulic cylinder, said end of said rod portion being slidably mounted to a pressing plate and said at least one fixing pin, thereby enabling said at least one fixing pin to move in the horizontal direction during the driving of said hydraulic cylinder.

5. A device for mounting a work member to an arm of construction equipment, comprising:

a structural support detachably mountable to said work member, said structural support being hingedly mountable to said arm;

at least one fixing pin;

at least one housing for receiving said at least one fixing pin for selectively engaging said work member, said at least one housing being disposed within said structural support;

a cylinder disposed within said structural support for engaging said at least one fixing pin with said work member; and isolation means for connecting said at least one fixing pin to said cylinder to minimize loading forces and shock applied to said at least one fixing pin from being directly transmitted to said cylinder, wherein said isolation means comprises slidably mounting said at least one fixing pin to a connecting member in communication with a rod portion of said cylinder.

6. The device according to claim 5, further comprising a pressing plate slidably mounted to at least one end of said at least one fixing pin.

* * * * *